US007597579B2

(12) United States Patent
Ikeya et al.

(10) Patent No.: US 7,597,579 B2
(45) Date of Patent: Oct. 6, 2009

(54) CONNECTOR APPARATUS

(75) Inventors: Kenichi Ikeya, Shizuoka-ken (JP); Kazumi Urano, Shizuoka-ken (JP); Hideki Inoue, Shizuoka-ken (JP); Takaaki Hirano, Shizuoka-ken (JP); Nozomi Ito, Tochigi-ken (JP)

(73) Assignees: Yazaki Corporation, Tokyo (JP); Calsonic Kansei Corporation, Saitama (JP)

( * ) Notice: Subject to any disclaimer, the term of this patent is extended or adjusted under 35 U.S.C. 154(b) by 0 days.

(21) Appl. No.: 12/251,962

(22) Filed: Oct. 15, 2008

(65) Prior Publication Data

US 2009/0098759 A1 Apr. 16, 2009

(30) Foreign Application Priority Data

Oct. 16, 2007 (JP) ..... P2007-268853

(51) Int. Cl.
*H01R 13/627* (2006.01)

(52) U.S. Cl. ..... 439/358; 439/278; 439/732

(58) Field of Classification Search ..... 439/358, 439/278, 281, 282, 732, 587
See application file for complete search history.

(56) References Cited

U.S. PATENT DOCUMENTS 4,090,759 A * 5/1978 Herrmann, Jr. ..... 439/281
4,193,655 A * 3/1980 Herrmann, Jr. ..... 439/166
7,059,901 B2 * 6/2006 Morita et al. ..... 439/587

FOREIGN PATENT DOCUMENTS

JP 3863739 10/2006

* cited by examiner

*Primary Examiner*—Tho D Ta
*Assistant Examiner*—Travis Chambers
(74) *Attorney, Agent, or Firm*—Finnegan, Henderson, Farabow, Garrett & Dunner, L.L.P.

(57) ABSTRACT

A connector apparatus comprises a connector, an annular member, and a cover member covering a rear surface of the connector. An engaging portion with a rear end surface is provided in the annular member. A step portion with a front end surface is provided in a rear portion of the connector. The cover member has a hook portion in the front end thereof. When the cover member covers the rear portion of the connector, the hook portion engages with the step portion. Thereafter, when the annular member is fixed to the connector, the rear end surface of the engaging portion and the front end surface of the step portion clamp the hook portion to prevent the hook portion from coming off.

4 Claims, 16 Drawing Sheets

CONNECTOR APPARATUS

CROSS REFERENCE TO RELATED APPLICATION

This application claims benefit of priority under 35 USC 119 based on Japanese Patent Application P2007-268853 filed Oct. 16, 2007, the entire contents of which are incorporated by reference herein.

BACKGROUND OF THE INVENTION

1. Field of the Invention

The present invention relates to the connector apparatus in which a cover member is mounted to a rear portion of a connector to protect noise-leaking or the like. The cover member is made of a soft material such that a rubber or the like, and a wire harness is drawn from the rear portion of the connector.

2. Description of the Related Art

A conventional connector apparatus is known to have a connector 501 and a grommet 510, as a cover member, mounted a rear portion of the connector 501, and the grommet 510 is made of rubber. The conventional connector is disclosed in FIG. 4 of the Japanese Patent No. 3863739.

In the conventional connector apparatus as described above, a pair of the connectors 501, 502 is engaged with each other through a through hole Pa of a panel P in a vehicle, and the grommet 510 seals a gap between the connectors 501, 502 and the panel P so as to protect noise-leaking to the rear of the connector 501.

Generally, when the cover member made of the soft material (hereinafter referred as the grommet 510) is mounted and fixed to the connector 501, a flange 503 is provided in an outer circumference of the connector 501 and an engaging groove 513 is provided in an inner circumference of the grommet 510. The flange 503 engages into the engaging groove 35 513, thereby protecting the grommet 510 from coming off.

SUMMARY OF THE INVENTION

However, if the grommet 510 is applied by an external force, for example, a tension caused by bending a wire harness, and in accordance with the external force acting to come off the grommet 510, there is a problem that the grommet 510 would easily come off.

With taking into consideration as described above, the object of the present invention is to provide the connector apparatus which enforces to hold the cover member mounted in a rear portion of a connector.

An aspect of the present invention is a connector apparatus comprising: a connector; a step portion provided in a circumference of a rear portion of the connector, the step portion having a front end surface; a cover member covering a rear surface of the connector, being made of a soft material, the cover member having: a first tubular member having a first diameter, provided in a rear end thereof; a second tubular member having a second diameter smaller than the first diameter, provided in a front end thereof, the second tubular member through which a wire harness is drawn; and a hook portion provided in the front end of the cover member, engaging with the step portion; and an annular member mounted and fixed on the circumference of a front portion of the connector. The front end surface of the step portion is formed so as to face a rear surface of the annular member when the annular member is mounted and fixed to the connector. When the hook portion engages with the step portion and the annular member is fixed to the connector, the hook portion is placed and clamped between the front end surface of the step portion and the rear surface of the annular member, thereby preventing the hook portion from being coming off from the connector.

In addition, the connector apparatus may further comprise a engaging means provided in the connector and the annular member, the engaging means engaging between the annular member and the connector by attaching the annular member to the connector from a front of the connector to a rear thereof thereby, preventing the annular member from being coming off to the front of the connector. The hook portion is clamped between a rear surface of the annular member and the front end surface of the step portion.

The connector apparatus of the present invention may further comprise an antislip means configured to clamp and fix the hook portion, the antislip means provided in at least one of the front end surface of the step portion and the rear surface of the annular member.

In the connector apparatus of the present invention, it is preferable that the connector is one of a pair of connectors engaging with each other through which a through hole of a panel interposed therebetween, the annular member is a unit main body provided in a panel seal unit mounted to a front circumference of the one of the connectors, and the unit main body has an annular sealing member made of a soft material, the annular sealing member provided in a front portion of the unit main body and sealing a gap between the panel and the one of the connectors.

DESCRIPTION OF THE EMBODIMENTS

Figure 1:
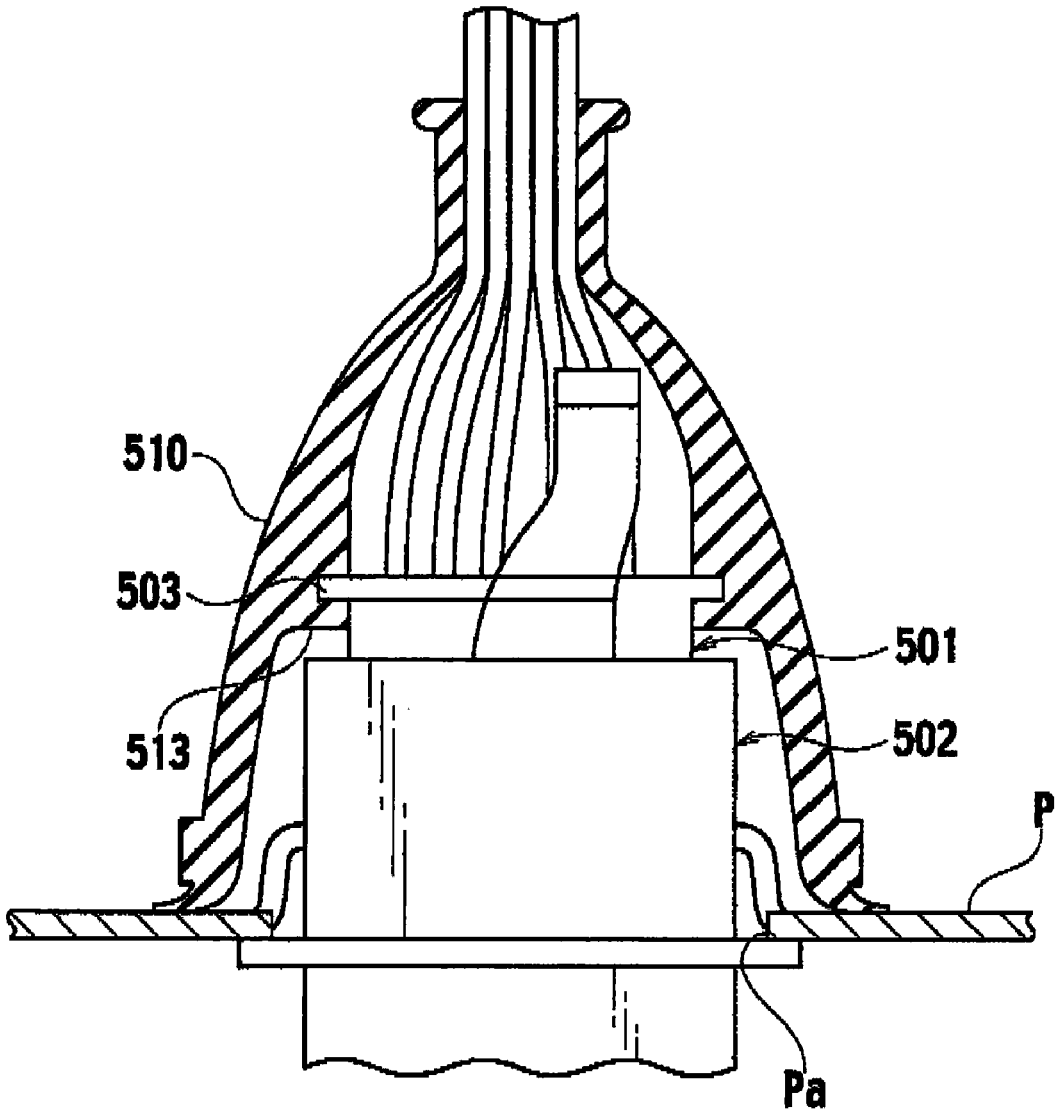
FIG. 1 is a figure showing a sectional view of a conventional connector apparatus.

Referring to the drawings, an embodiment of the present invention is explained hereinafter.

A connector apparatus is configured mainly by a connector 10 which is one of a pair of connectors 10, 200 and is arranged in a compartment side. The connectors are engaged with each other through a through hole Pa of a panel P partitioning off an engine room and the compartment. The connector apparatus comprises: a connector 10 in the compartment; a panel seal unit 20 mounted to a circumference in the front part of the connector 10; and a cover member 30 mounted to a rear part of the connector 10. The cover member is arranged mainly to prevent noises generated in the engine room from leaking to the compartment.

Figure 2:
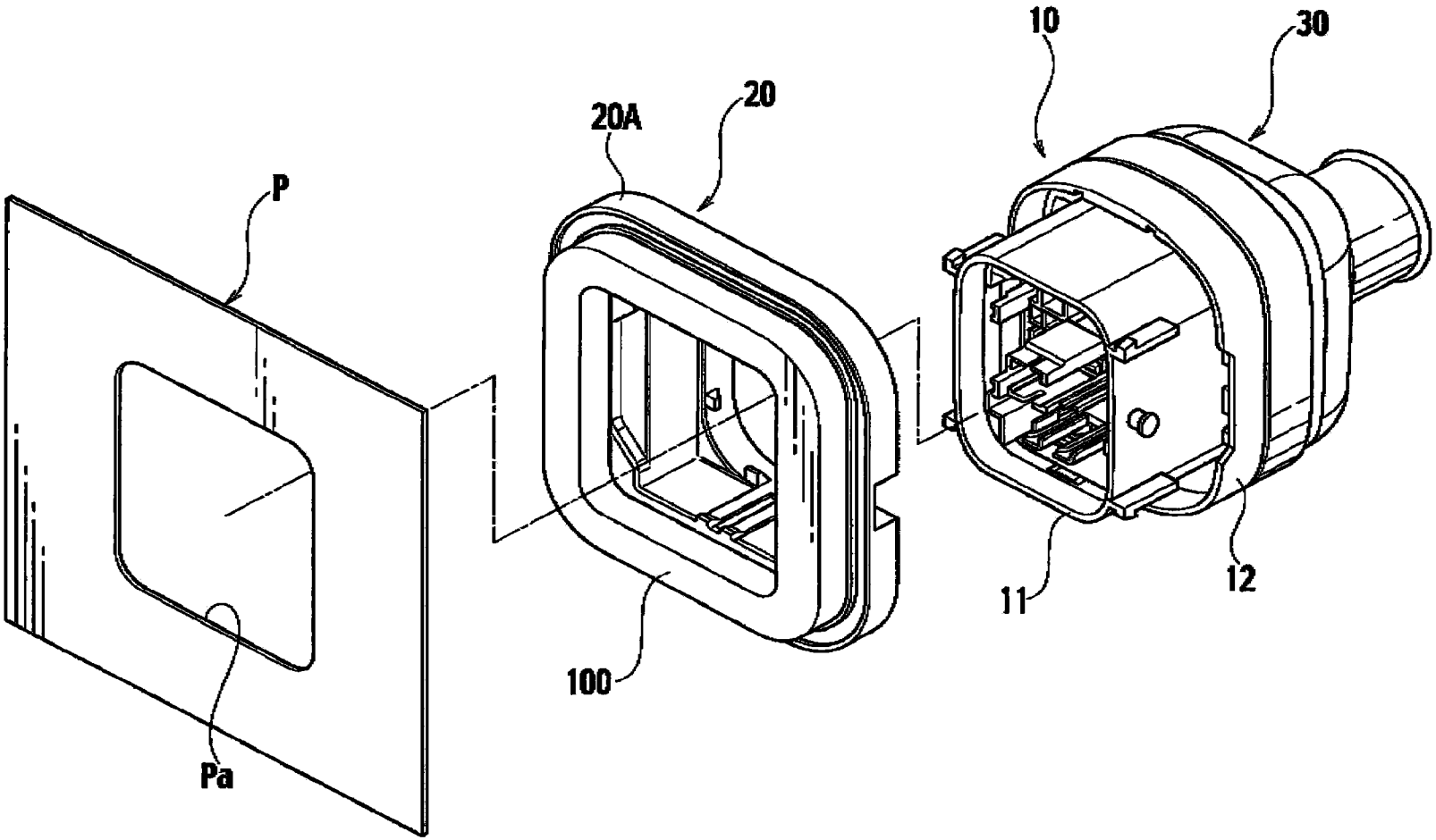
FIG. 2 is an exploded perspective view of a connector apparatus according to an embodiment of the present invention.

The panel seal unit 20 seals a gap between the connector 10 and the panel P. As shown in FIG. 2, the panel seal unit 20 comprises an annular unit main body (annular member) 20A made of hard resin material, and a annular seal member 100 installed on a front surface. The annular seal member 100 is made of soft material such as a rubber.

Figure 3:
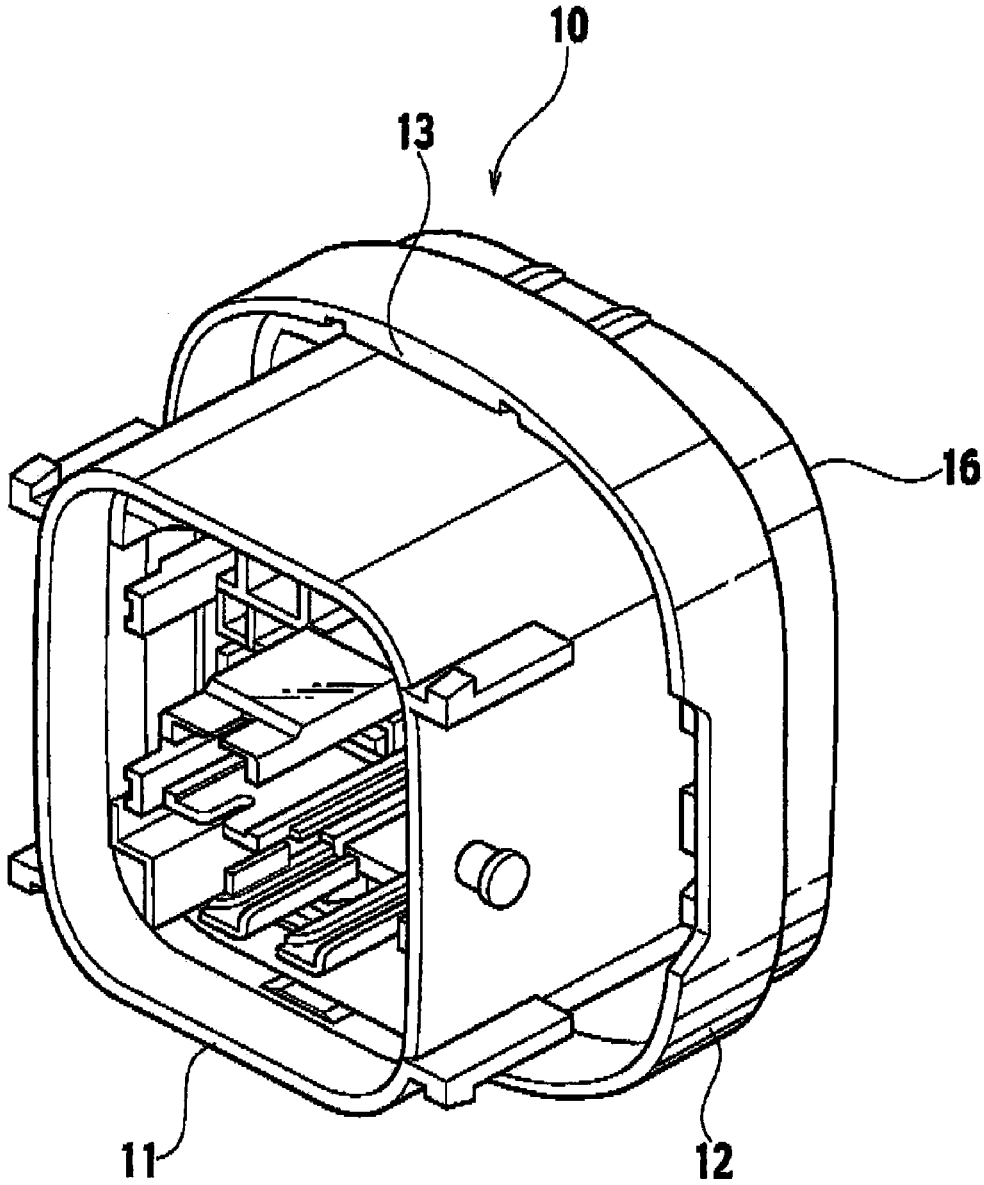
FIG. 3 is a perspective view of a connector body in the connector apparatus.
Figure 4:
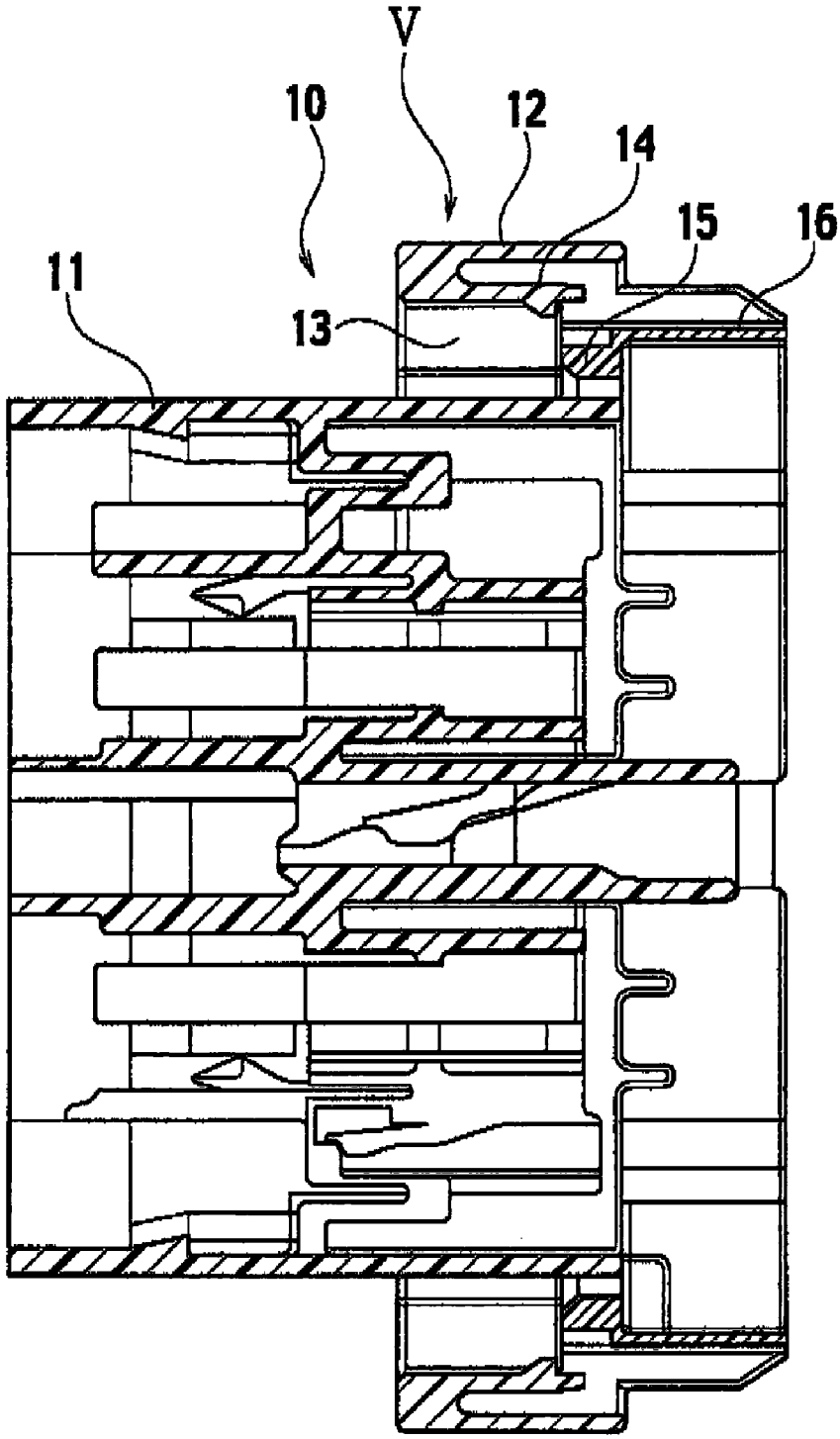
FIG. 4 is a sectional view of the connector body.
Figure 5:
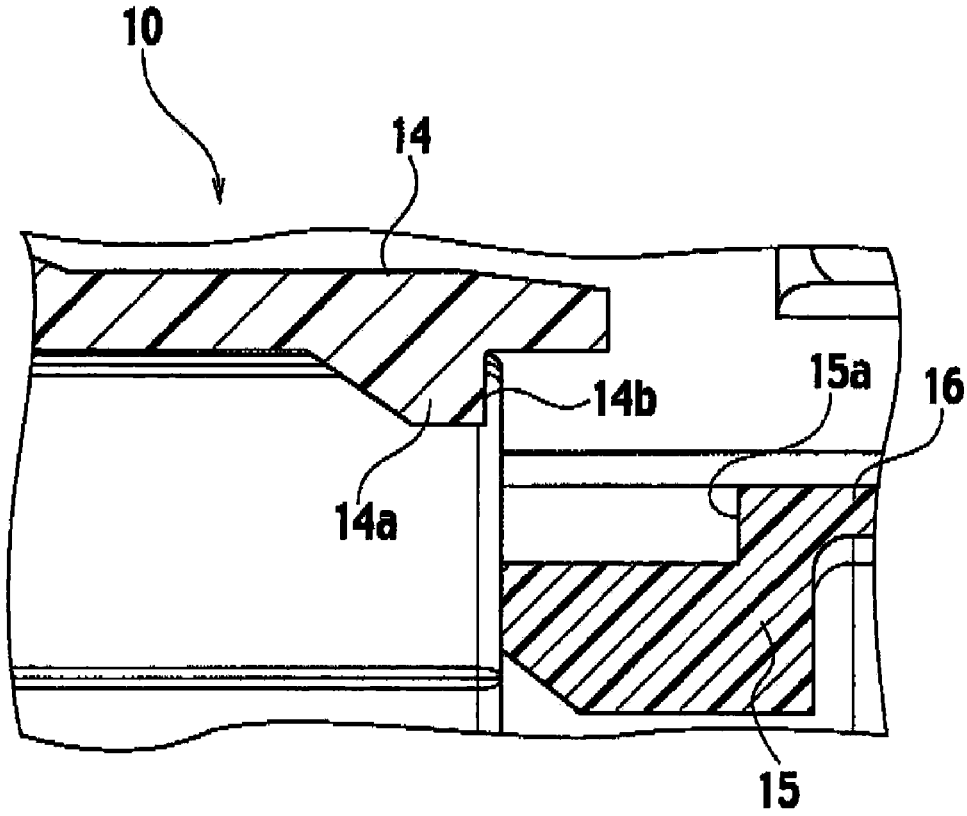
FIG. 5 is an extended view of x part of FIG. 4.

As shown in FIGS. 3-5, the connector 10 is configured by a connector housing made by molding a hard resin. The connector housing accommodates a plurality of terminals (not shown). The connector 10 also includes wires connecting to the terminals. The wires are bundled as a wire harness and drawn to the outside from the rear portion of the connector 10.

The connector 10 has an engaging hood portion 11 in the front portion thereof to be engaged with the corresponding connector 200. The connector 10 has a tubular wall 12 in the outer circumference in the rear part thereof with interposing an annular clearance 13 therebetween. Further, the connector 10 has a tubular wall 16 located behind the tubular wall 12. the tubular wall 16 is used for attaching the front part of the cover member 30. In the tubular wall 16, a step portion 15 facing forwardly to engage with a hook portion 35 (described later) provided in the front part of the cover member 30.

In an inner circumference of the tubular wall 12 in the connector 10, an engaging arm (engaging means) 14 is provided to engage with a rear end portion of the panel seal unit 20 which is inserted into the annular clearance 13. A engaging protruding portion 14*a* is provided in a free end of the engaging arm 14, a rear end surface of the engaging protruding portion 14*a* constitute an engaging wall 14*b* preventing the panel seal unit 20 from coming off forwardly.

Figure 6:
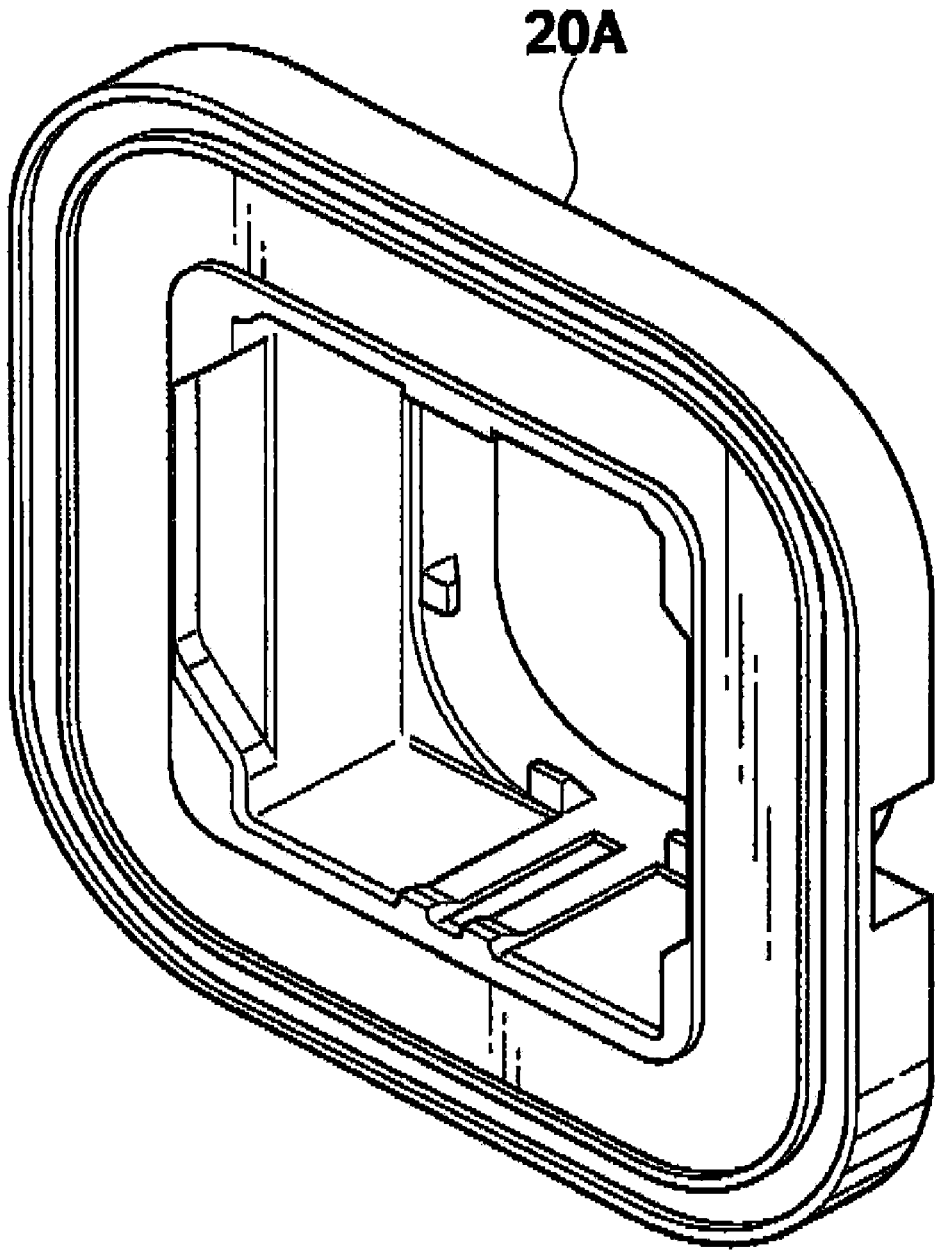
FIG. 6 is a perspective view of a unit main body of a panel seal unit constituting the connector apparatus of FIG. 2.
Figure 7:
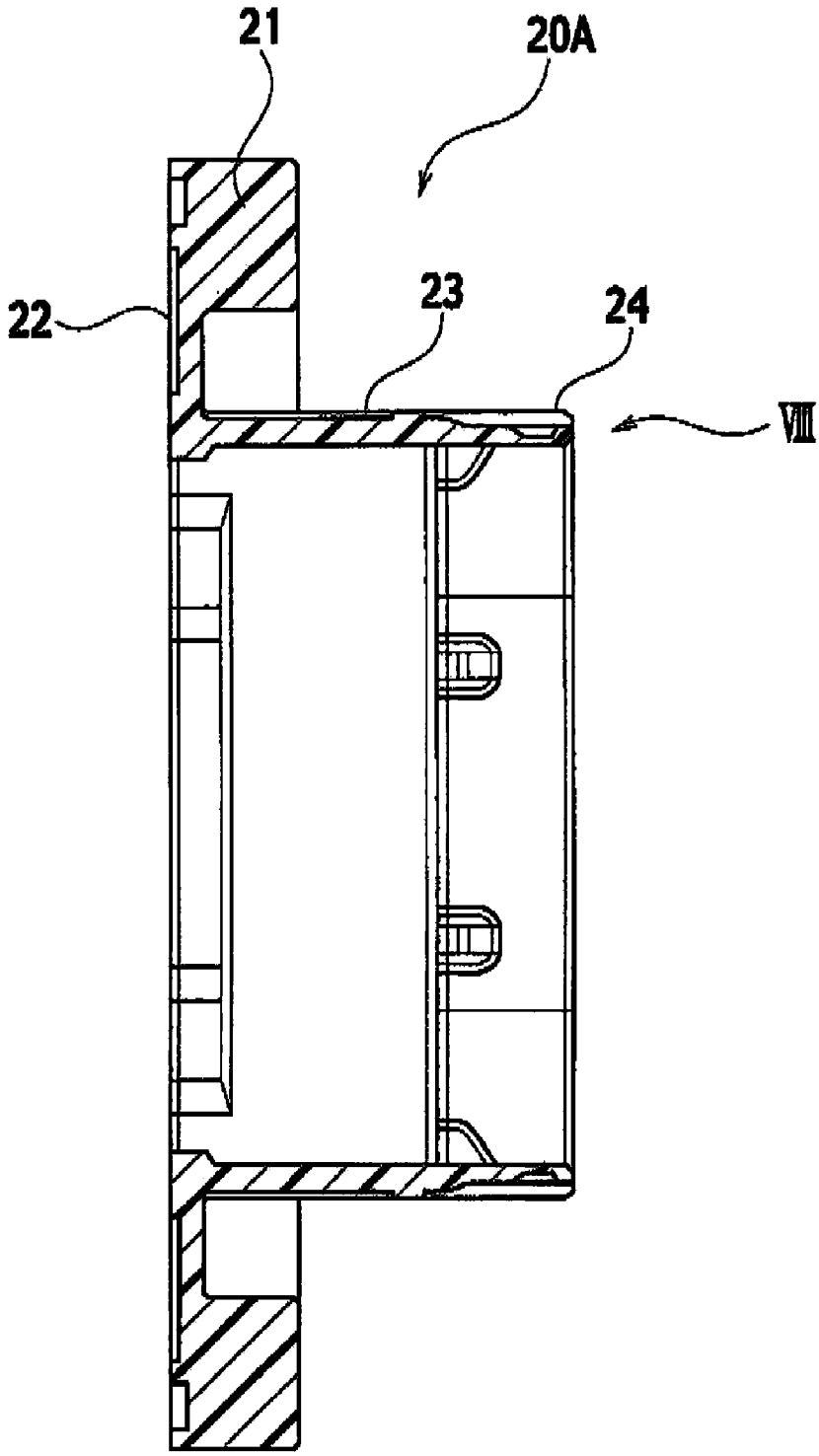
FIG. 7 is a sectional view of the unit main body.
Figure 8:
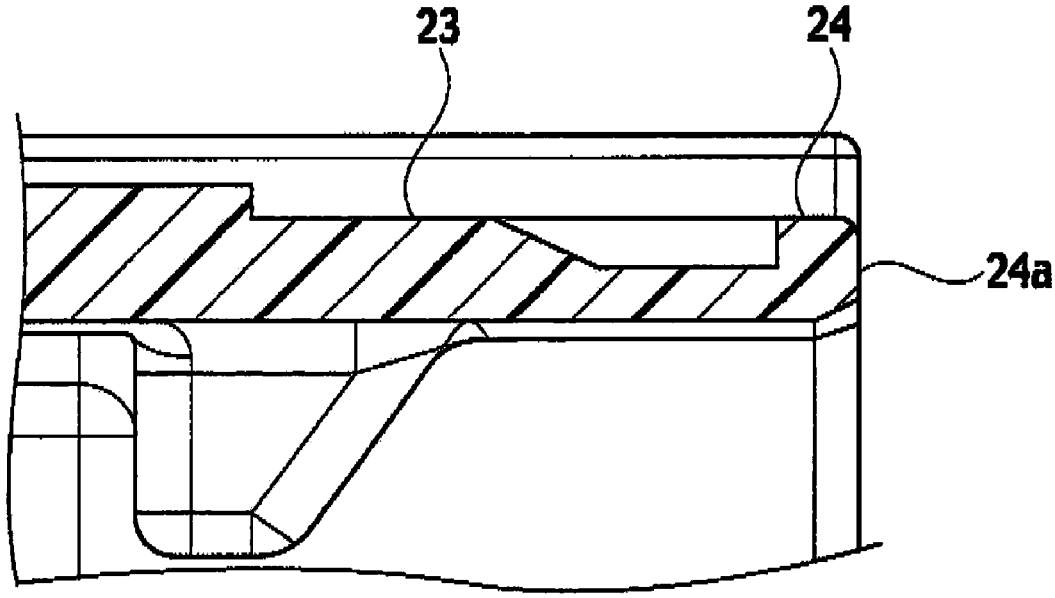
FIG. 8 is an extended view of VIII part of FIG. 7.

As shown in FIGS. 6-8, a unit main body 20A of the panel seal unit 20 comprises: an annular flange portion 21 having a seal attaching surface 22 on a front surface thereof; a tubular wall 23 formed backwardly from an end portion of the inner circumference of the flange portion 21, the tubular wall 23 engaging with the outer circumference of the engaging hood portion 11 in the connector 10; and a engaging portion (engaging means) 24 provided in the rear end of the tubular wall 23.

The engaging portion 24 engages with the engaging protruding portion 14*a* of the engaging arm 14 when the rear end portion of the tubular wall 23 is inserted from the front to the annular clearance 13 of the connector 10, thereby protecting forward movement of the panel seal unit 20. In this engaging state, a rear end surface 24*a* of the engaging portion 24 faces to a front end surface 15*a* of the step portion 15 in the connector 10.

Figure 9:
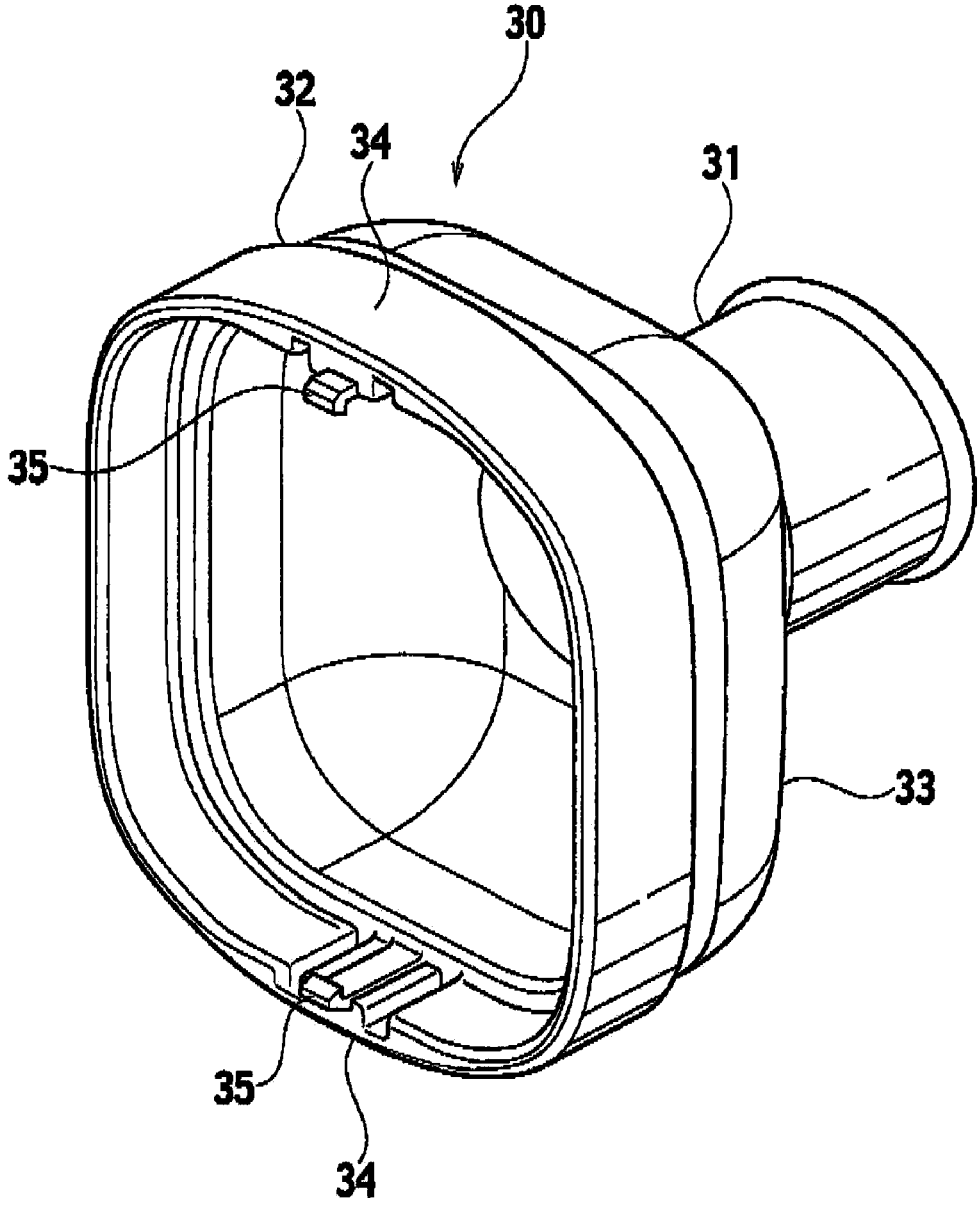
FIG. 9 is a perspective view of a cover member constituting the connector apparatus of FIG. 2.
Figure 10:
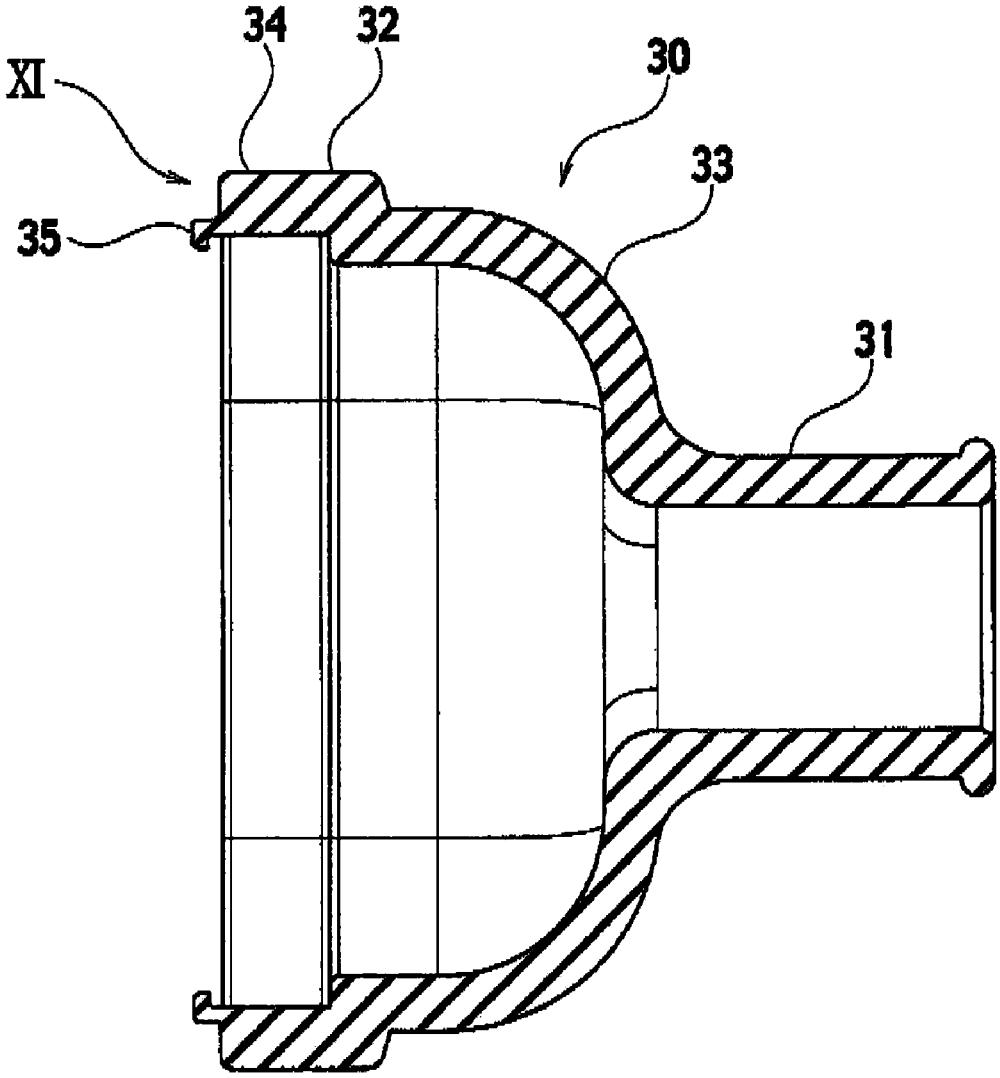
FIG. 10 is sectional view of the cover member.
Figure 11:
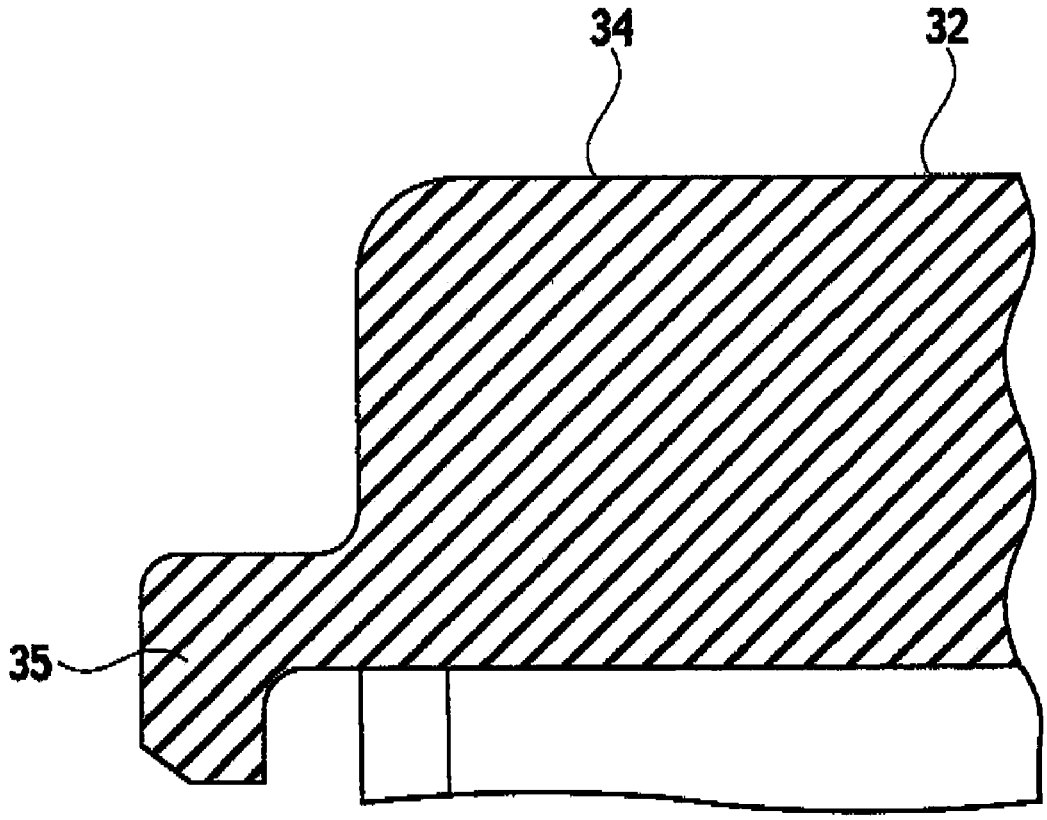
FIG. 11 is an extended view of XI part of FIG. 10.

As shown in FIGS. 9-11, the cover member 30 is formed in funnel shape by molding a rubber or a soft resin material. The cover member 30 has a small tubular portion 31 in the rear portion thereof, a large tubular portion 32 in the front portion thereof, and a circular cone-shaped portion 33 provided therebetween, the circular cone-shaped portion 33 connecting the small tubular portion 32 and the large tubular portion 32. A diameter of the small tubular portion 31 is substantially smaller than that of the large tubular portion 32. In other words, a cross section of the small tubular portion 32 is smaller than that of the large tubular portion 32. A thick wall portion 34 is formed in each of two positions which are opposite each other in the large tubular portion 32. In the front end of the thick wall portion, a hook portion 35 is formed in L-shape extending inwardly.

When the connector apparatus is assembled, the cover member 30 is mounted on the rear portion of the connector 10 so as to cover it, the large tubular portion 32 engages with the outer circumference of the tubular wall 16 of the connector 10, and a wire harness drawn from the rear face of the connector 10, is drawn through the small tubular portion 31.

Figure 12:
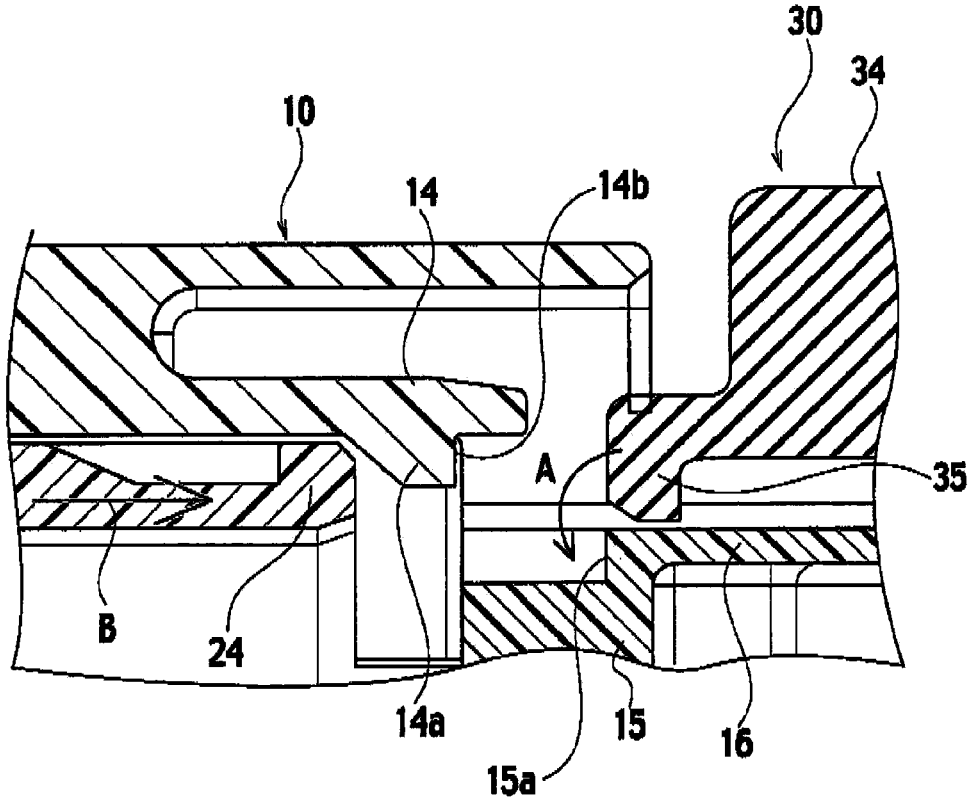
FIG. 12 is an expanded sectional view showing a state where the cover member comes to engage with an outer circumference in a rear portion of the connector and the panel seal unit comes to be mounted from front the connector and to be fixed a circumference of the connector.

Further, as shown in FIG. 12, the hook portion 35 in the cover member 30 is engaged with the step portion 15 provided in the outer circumference of the tubular wall 16 in a direction depicted by an arrow A. While keeping this state, the engaging portion 24 in the rear end of the panel seal unit 20 is slid backwardly depicted by an arrow B, and the engaging portion 24 is engaged with the engaging arm 14 in the connector 10.

Figure 13:
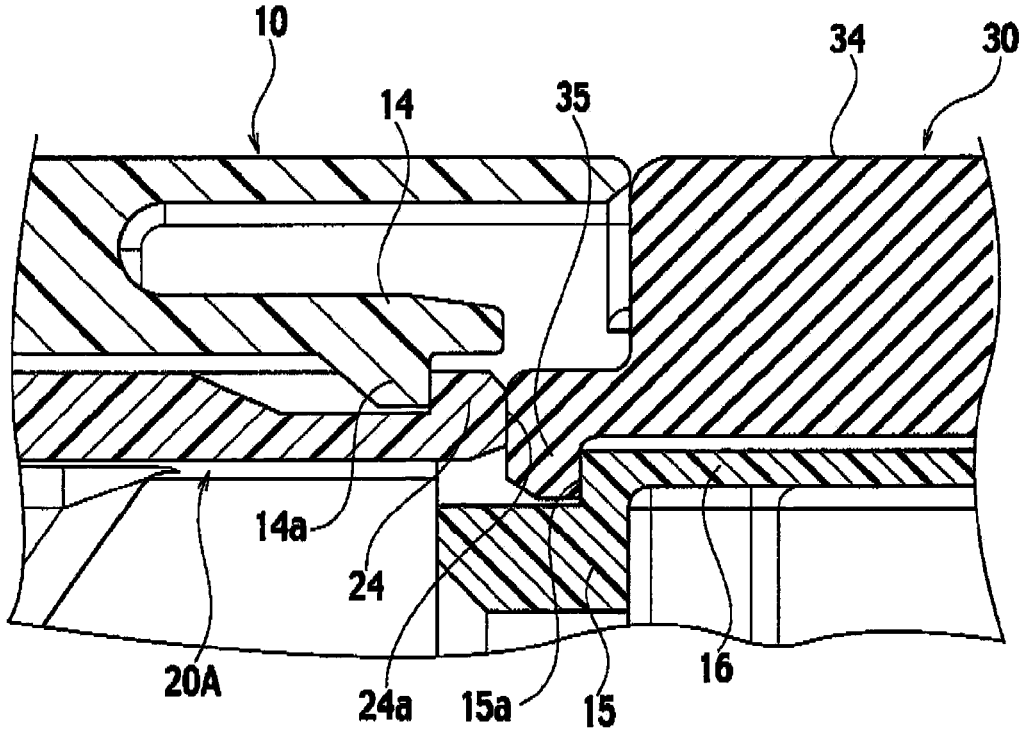
FIG. 13 is an expanded sectional view showing a next state of FIG. 12, which shows a state where a front end of the cover member has engaged with a step portion provided in an outer circumference of a rear portion of the connector and a state where a hook portion of the cover member has been clamped and fixed by a rear surface of the panel seal unit and the front end surface of the step portion by attaching and fixing the panel seal unit to the outer circumference of the connector
Figure 14:
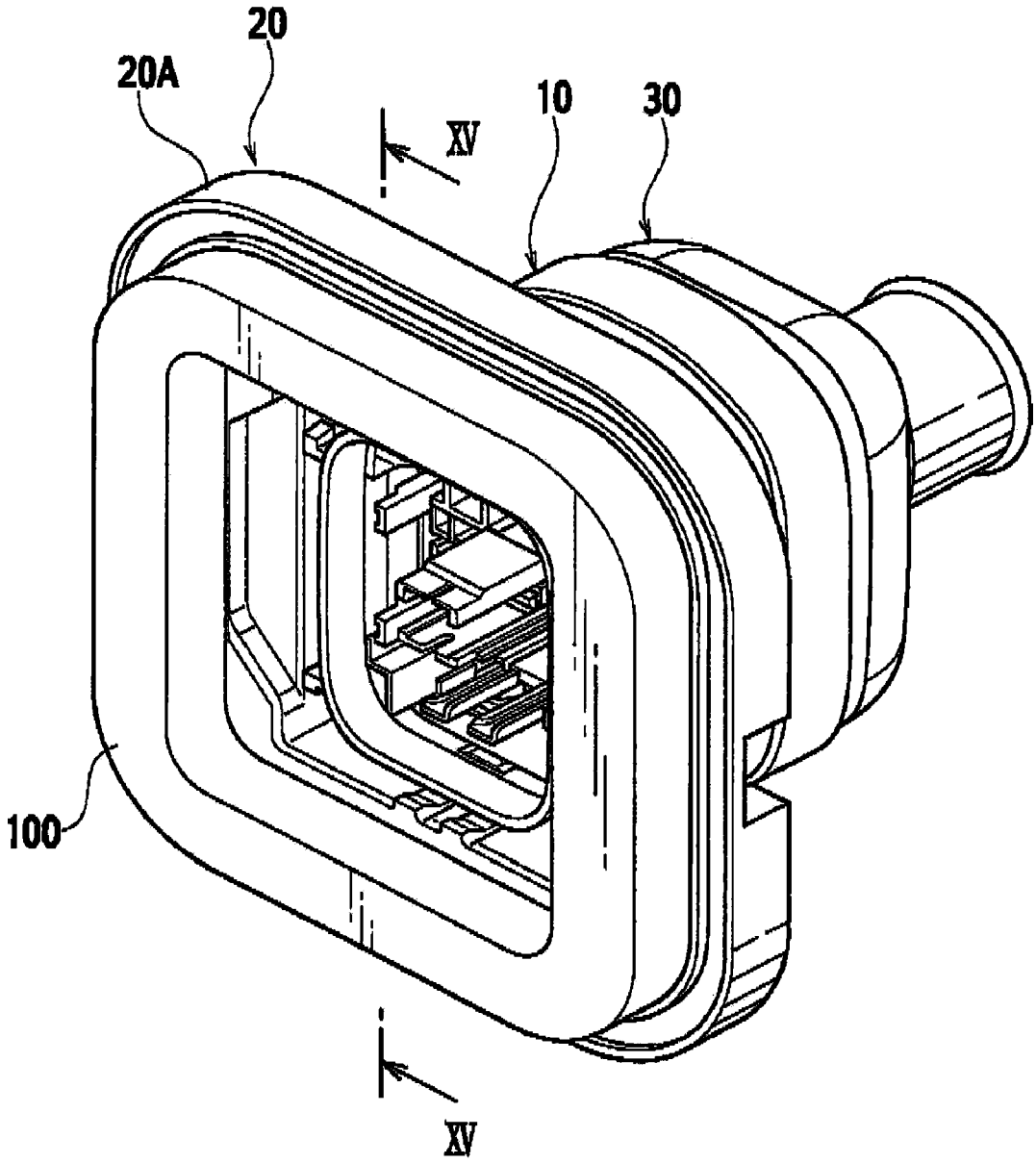
FIG. 14 is an implementation perspective view of the connector apparatus.
Figure 15:
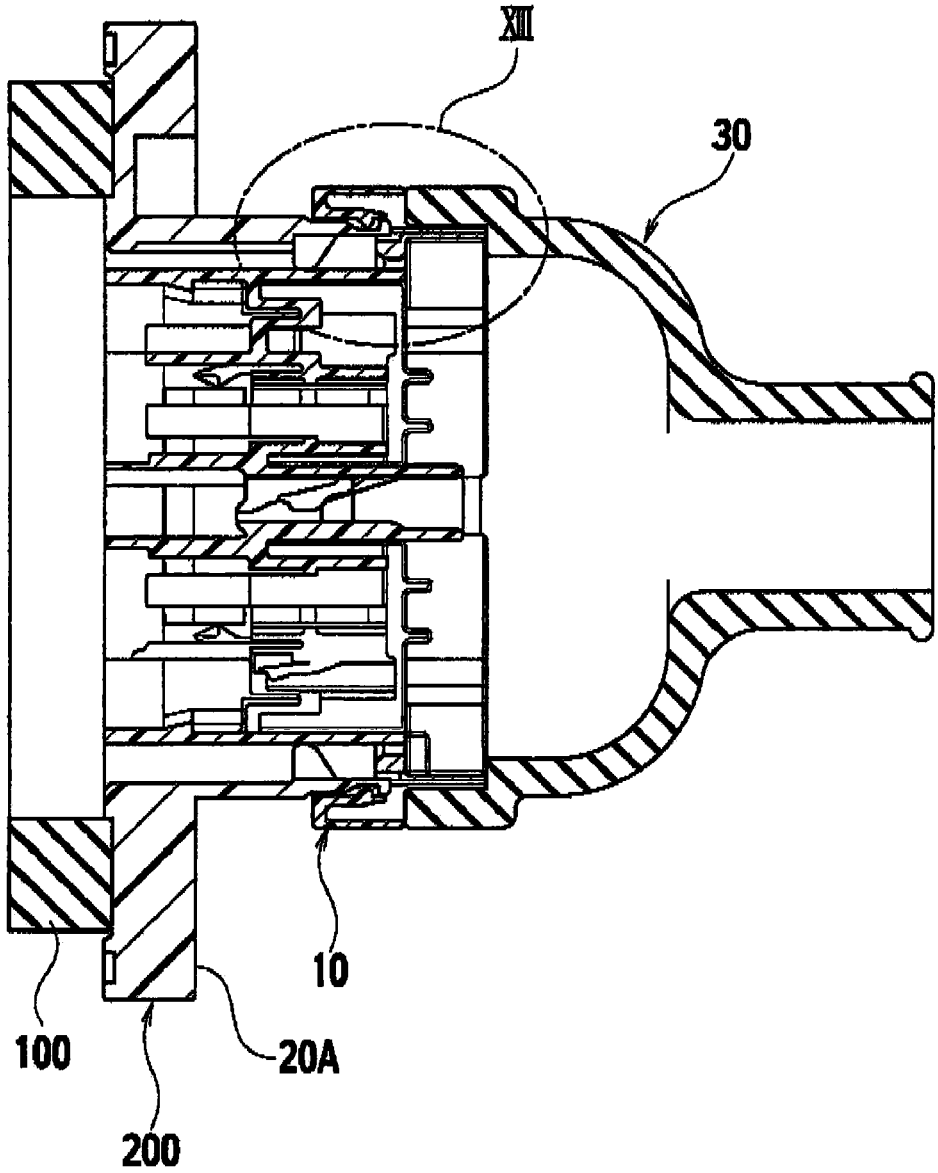
FIG. 15 is a sectional view of the connector apparatus including a XV-XV line of FIG. 14.
Figure 16:
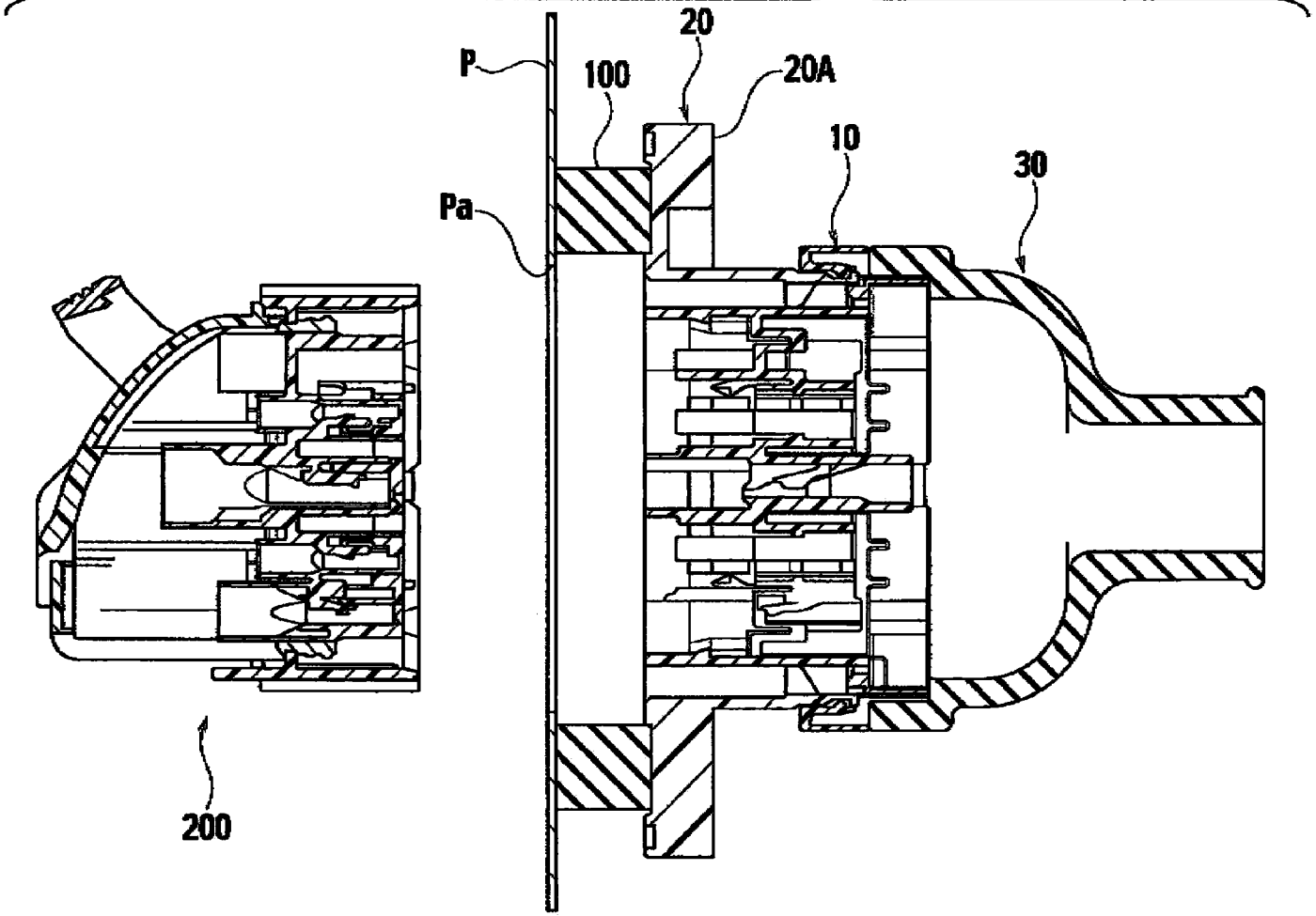
FIG. 16 is a sectional view of the connector apparatus of an embodiment according to the present invention, the view showing the connector apparatus comes to engage with a corresponding connector through a through hole of the panel.

Accordingly, as shown in FIGS. 14 and 15, the connector 10 and the panel seal unit 30 forms in one body, and assembling of the connector apparatus is completed. In this assembly, as shown in FIG. 13, the hook portion 35 of the cover member 30 is clamped between the front end surface of the step portion 15 in the connector 10 and the rear end surface 24*a* of the engaging portion 24 in the panel seal unit 20, thereby preventing it from coming off.

According to the connector apparatus as described above, the hook portion 35 is provided in the front end of the cover member 30, and the hook portion 35 is clamped and fixed between the rear end surface 24*a* of the engaging portion 24 and the front end surface 15*a* of the step portion 15. Accordingly, it is possible to firmly hold the cover member 30 not to come off if an external force is applied thereto. Further, it is possible to clamp the hook portion 35 only by installing the panel seal unit 20 after the cover member 30 is mounted. Therefore, a work to enhance prevention of coming off the cover member 30 is easily performed.

In addition, the prevention of coming off the cover member 30 is further enhanced by providing an antislip means in at least one of the front end surface 15*a* of the step portion 15 and the rear end portion 24*a* of the engaging portion 24. For example, the anitslip means is accomplished by forming an uneven surface thereon. On the other hand, the same effect can be provided by forming the uneven surface on at least one of surfaces of the hook portion 35 which touch the rear end surface 24*a* and the front end surface 15*a*.

What is claimed is:

1. A connector apparatus comprising:

a connector;

a step portion provided in a circumference of a rear portion of the connector, the step portion having a front end surface;

a cover member covering a rear surface of the connector, being made of a soft material, the cover member having:

a first tubular member having a first diameter, provided in a rear end thereof;

a second tubular member having a second diameter smaller than the first diameter, provided in a front end thereof, the second tubular member through which a is wire harness is drawn; and a hook portion provided in the front end thereof, engaging with the step portion; and an annular member mounted and fixed on the circumference of a front portion of the connector;

wherein the front end surface of the step portion is formed so as to face a rear surface of the annular member when the annular member is mounted and fixed to the connector; and when the hook portion engages with the step portion and the annular member is fixed to the connector, the hook portion is placed and clamped between the front end surface of the step portion and the rear surface of the annular member, thereby preventing the hook portion from being coming off from the connector.

2. The connector apparatus according to claim 1, further comprising a engaging means provided in the connector and the annular member, the engaging means engaging between the annular member and the connector by attaching the annular member to the connector from a front of the connector to a rear thereof thereby, preventing the annular member from being coming off to the front of the connector, wherein the hook portion is clamped between a rear surface of the annular member and the front end surface of the step portion.

3. The connector apparatus according to claim 1, further comprising an antislip means configured to clamp and fix the hook portion, the antislip means provided in at least one of the front end surface of the step portion and the rear surface of the annular member.

4. The connector apparatus according to claim 1, wherein the connector is one of a pair of connectors engaging with each other through which a through hole of a panel interposed therebetween, the annular member is a unit main body provided in a panel seal unit mounted to a front circumference of the one of the connectors, and the unit main body has an annular sealing member made of a soft material, the annular sealing member provided in a front portion of the unit main body and sealing a gap between the panel and the one of the connectors.

* * * * *